US009863682B2

(12) United States Patent
Broadbent

(10) Patent No.: US 9,863,682 B2
(45) Date of Patent: Jan. 9, 2018

(54) WATER DISTRIBUTION FOR AN ICE MAKER

(71) Applicant: True Manufacturing Company, Inc., O'Fallon, MO (US)

(72) Inventor: John Allen Broadbent, Denver, CO (US)

(73) Assignee: True Manufacturing Company, Inc., O'Fallon, MO (US)

( * ) Notice: Subject to any disclaimer, the term of this patent is extended or adjusted under 35 U.S.C. 154(b) by 462 days.

(21) Appl. No.: 14/167,089

(22) Filed: Jan. 29, 2014

(65) Prior Publication Data

US 2014/0208792 A1 Jul. 31, 2014

Related U.S. Application Data

(60) Provisional application No. 61/758,439, filed on Jan. 30, 2013.

(51) Int. Cl.
*F25C 1/00* (2006.01)
*F25C 1/22* (2006.01)

(52) U.S. Cl.
CPC ..... *F25C 1/225* (2013.01)

(58) Field of Classification Search
CPC ..... F25C 1/225; F25C 1/12; F25C 2400/02
See application file for complete search history.

(56) References Cited

U.S. PATENT DOCUMENTS 5,182,925 A * 2/1993 Alvarez ..... F25B 39/024 62/347
6,148,621 A 11/2000 Byczynski et al.
7,340,913 B2 3/2008 Miller et al.
2005/0109056 A1* 5/2005 Rand ..... F25B 5/04 62/340
2006/0026986 A1* 2/2006 Miller ..... F25C 1/225 62/340

OTHER PUBLICATIONS

Scotsman Ice Systems Installation and User's Manual for Modular Cuber Models C0322, C0522, C0722, C0330, C0530, C0630, C0830, and C1030, dated Nov. 2012, 23 pages.
Ice-O-Matic Service and Installation Manual The Ice Series Cubers ICE0250 through ICE2100 Series, includes undercounter and 22 Inch Series, dated Nov. 2009, 174 pages.

* cited by examiner

*Primary Examiner* — Elizabeth Martin
(74) *Attorney, Agent, or Firm* — Bryan Cave LLP

(57) ABSTRACT

A water distributor for an ice maker having a first reservoir comprising a bottom and an inlet passageway, a central wall comprising a first central wall portion and a second central wall portion, and a second reservoir separated from the first reservoir by the central wall, the second reservoir comprising a bottom. A population of teeth separated by a population of gaps are disposed along the central wall. Water flows from the first reservoir to the second reservoir through the population of gaps. A population of outlet passageways are disposed in the second central wall portion proximate the bottom of the second reservoir. Water exits the second reservoir substantially horizontally through the population of outlet passageways.

32 Claims, 14 Drawing Sheets

WATER DISTRIBUTION FOR AN ICE MAKER

FIELD OF THE INVENTION

This invention relates to ice makers generally and in particular to an ice maker comprising an improved water distributor.

BACKGROUND OF THE INVENTION

Ice making machines, or ice makers, that employ freeze plates which comprise lattice-type cube molds and have gravity water flow and ice harvest are well known and in extensive use. Such machines have received wide acceptance and are particularly desirable for commercial installations such as restaurants, bars, motels and various beverage retailers having a high and continuous demand for fresh ice.

In these ice makers, water is supplied to the top of a freeze plate by a water distributor and the freeze plate directs the water in a tortuous path toward a water pump. A portion of the supplied water collects on the freeze plate, freezes into ice and is identified as sufficiently frozen by suitable means whereupon the freeze plate is defrosted such that the ice is slightly melted and discharged therefrom into a bin. Typically, these ice machines can be classified according to the type of ice they make. One such type is a grid style ice maker which makes generally square ice cubes that form within individual grids of the freeze plate which then form into a continuous sheet of ice cubes as the thickness of the ice increases beyond that of the freeze plate. After harvesting, the sheet of ice cubes will break into individual cubes as they fall into the bin. Another type of ice maker is an individual ice cube maker which makes generally square ice cubes that form within individual grids of the freeze plate which do not form into a continuous sheet of ice cubes. Therefore, upon harvest individual ice cubes fall from the freeze plate and into the bin. Various embodiments of the invention can be adapted to either type of ice maker, and to others not identified, without departing from the scope of the invention. Accordingly, the freeze plate as described herein encompasses any number of types of molds for creating a continuous sheet of ice cubes, individual ice cubes, and/or cubes of different shapes. Control means are provided to control the operation of the ice maker to ensure a constant supply of ice.

Typically disposed along the top of the freeze plate is some type of water distributor that attempts to distribute water as evenly as possible along the pocketed or gridded surface of the freeze plate. It is important to distribute water evenly so that ice forms consistently across the freeze plate surface. In addition to being capable of distributing water evenly, the water distributor needs to be simple to install and remove for cleaning, should require a minimal amount of water pressure to function properly, and should be inexpensive to make.

FIG. 1A, identifies a prior art water distributor design 210 which is characterized as a tube-within-a-tube design. Interior tubes 228 are two separately molded parts positioned coaxially within outer tube 230. Water is pumped into interior tubes 228, which have a population of passageways 232 disposed in an upper portion of interior tubes 228. From passageways 232 of interior tube 228, water flows into the annular space between interior tube 228 and outer tube 230. Outer tube 230 also includes a population of passageways 234 in a lower portion of outer tube 230 through which the water flows onto a freeze plate (not shown). This prior art water distributor 210 is expensive to make, is made from many pieces, requires disassembly and considerable time to clean, is difficult to reassemble, requires two water-tight interconnections and, because of the torturous water path created, requires significant water pressure to function properly.

Designs for non-tubular water distributors have also been used. U.S. Pat. No. 6,148,621 entitled "Domestic Clear Ice Maker" granted to Byczynski et al. discloses a water distributor that introduces water onto a floor containing a series of barriers. The design of Byczynski is inadequate to operate at low pressure, is oversized, is likely expensive to make, and requires a fastener to mount the water distributor to the ice maker. Tools, therefore, are required to remove and reinstall the water distributor.

Another prior art water distributor is shown in FIG. 1B. The water distributor 310 includes two laterally extending parallel reservoirs 312 and 314. Wall 316 dividing reservoirs 312 and 134 includes non-uniformly spaced and non-uniformly wide passages 317 for water to travel from reservoir 312 to the reservoir 314. Reservoir 314 includes a series of passageways 318 in a bottom horizontal surface of reservoir 314 that allows water to exit onto a freeze plate (not shown). Obstructions 320 in reservoirs 312 and 314 attempt to divert and control the flow of water. In this water distributor 310, water exits directly downward instead of being directed at the face of the freeze plate. Therefore, yet another element is required to redirect the water toward the freeze plate. Tabs 322 at either end of water distributor 310 are used to locate water distributor 310. Additionally, tabs 322 must be aligned with mounting points on the ice maker (not shown) at either end to properly mount water distributor 310. Additionally, water enters water distributor 310 horizontally through inlet passageway 324 rather than substantially vertically upward from below, where the sump (not shown) is located. The velocity of the entering water creates the need of obstructions 320 to slow the momentum of the water to prevent uneven distribution across the freeze plate. The non-uniformly spaced and non-uniformly wide passages 317 additionally are likely required to prevent uneven distribution across the freeze plate due to the high velocity and horizontal entry of the water. This water distributor 310 also requires significant water pressure to function properly due to the torturous path the water must take to pass through and exit water distributor 310. Furthermore, an additional part, lid 330 is required to cover reservoirs 312, 314 to prevent the supplied water from spraying, squirting, spewing, gushing or otherwise leaking from reservoirs 312, 314. Because inlet passageway 324 is horizontal while the rest of the geometry in water distributor 310 is vertical, the mold which forms water distributor 310 must pull apart primarily in a vertical direction and additionally must have a horizontal or "side pull" in order to form inlet passageway 324. Having the additional horizontal pull adds complexity and cost to the mold needed to form water distributor 310.

Therefore, a need exists in the art for a water distributor for an ice maker that is simply mounted and removed for cleaning without tools or fasteners, is inexpensive to manufacturer, consists of only one part, minimizes the cost of the mold needed to form the part, provides for water to exit the water distributor with some horizontal velocity so that water will contact the face of the freeze plate without further diversion, provides for water to enter the water distributor upwardly from below for simplified connection to the water source, and a simple water flow path which minimizes the water pressure, and thus the energy, required to make the water distributor function properly.

SUMMARY OF THE INVENTION

Briefly, therefore, one embodiment of the invention is directed to a water distributor for use in an ice maker. The water distributor comprises a first reservoir comprising a bottom and an inlet passageway, the inlet passageway adapted to permit water to enter the first reservoir, a central wall comprising a first central wall portion and a second central wall portion, and a second reservoir separated from the first reservoir by the central wall, and wherein the second reservoir includes a bottom. A population of teeth may be disposed along the central wall, wherein the population of teeth are separated by a population of gaps, and wherein water may flow from the first reservoir to the second reservoir through one or more of the population of gaps. The water distributor further includes a population of outlet passageways disposed in the second central wall portion proximate the bottom of the second reservoir. Water may exit the second reservoir through one or more of the population of outlet passageways with a horizontal velocity component.

Another embodiment of the invention is directed to an ice maker for forming ice, the ice maker including a refrigeration system and a water system. The refrigeration system comprises a compressor, a condenser, a thermal expansion device, an evaporator assembly, a freeze plate thermally coupled to the evaporator assembly, and a hot gas valve. The water system comprises a water pump, a water distributor, a water line in fluid communication with the water pump and the water distributor, and a sump located below the freeze plate adapted to hold water. The water distributor comprises a first reservoir comprising a bottom and an inlet passageway, the inlet passageway adapted to permit water to enter the first reservoir, a central wall comprising a first central wall portion and a second central wall portion, and a second reservoir separated from the first reservoir by the central wall, and wherein the second reservoir includes a bottom. A population of teeth may be disposed along the central wall, wherein the population of teeth are separated by a population of gaps, and wherein water may flow from the first reservoir to the second reservoir through one or more of the population of gaps. The water distributor further includes a population of outlet passageways disposed in the second central wall portion proximate the bottom of the second reservoir. Water may exit the second reservoir through one or more of the population of outlet passageways with a horizontal velocity component.

BRIEF DESCRIPTION OF THE FIGURES

These and other features, aspects and advantages of the invention will become more fully apparent from the following detailed description, appended claims, and accompanying drawings, wherein the drawings illustrate features in accordance with exemplary embodiments of the invention, and wherein:

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Embodiments of the ice maker described herein comprise a water distributor that cascades water down a freeze plate. Embodiments of water distributor include a nipple for attachment of a water line that supplies water to water distributor vertically from a sump located below the water distributor. The water distributor may be configured to be mounted and removed without the use of fasteners and tools.

The water distributor may be configured to allow water to exit from a population of outlet passageways disposed along a substantially vertical wall of the water distributor rather than through a population of outlet passageways disposed in a horizontal surface of the water distributor. This allows the water exiting the water distributor to have a horizontal velocity component upon exiting the water distributor. Accordingly, this horizontal velocity component directs the exiting water at the freeze plate and permits the water to fan out into a sheet of water without requiring an additional part to redirect the water toward the freeze plate after leaving the water distributor.

Figure 1A:
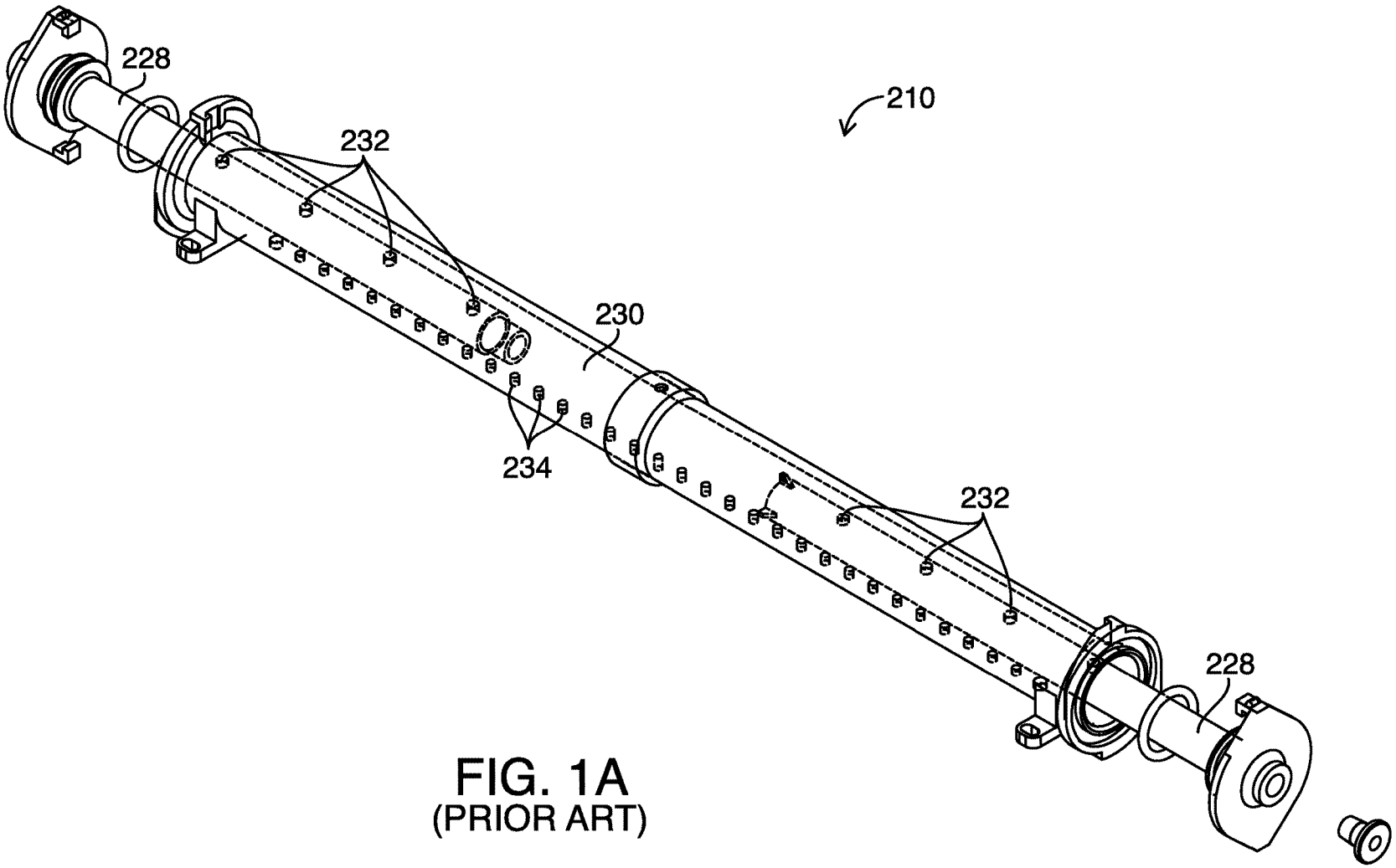
FIG. 1A (PRIOR ART)
FIG. 1A is a right perspective view of a water distributor according to the prior art.
Figure 1B:
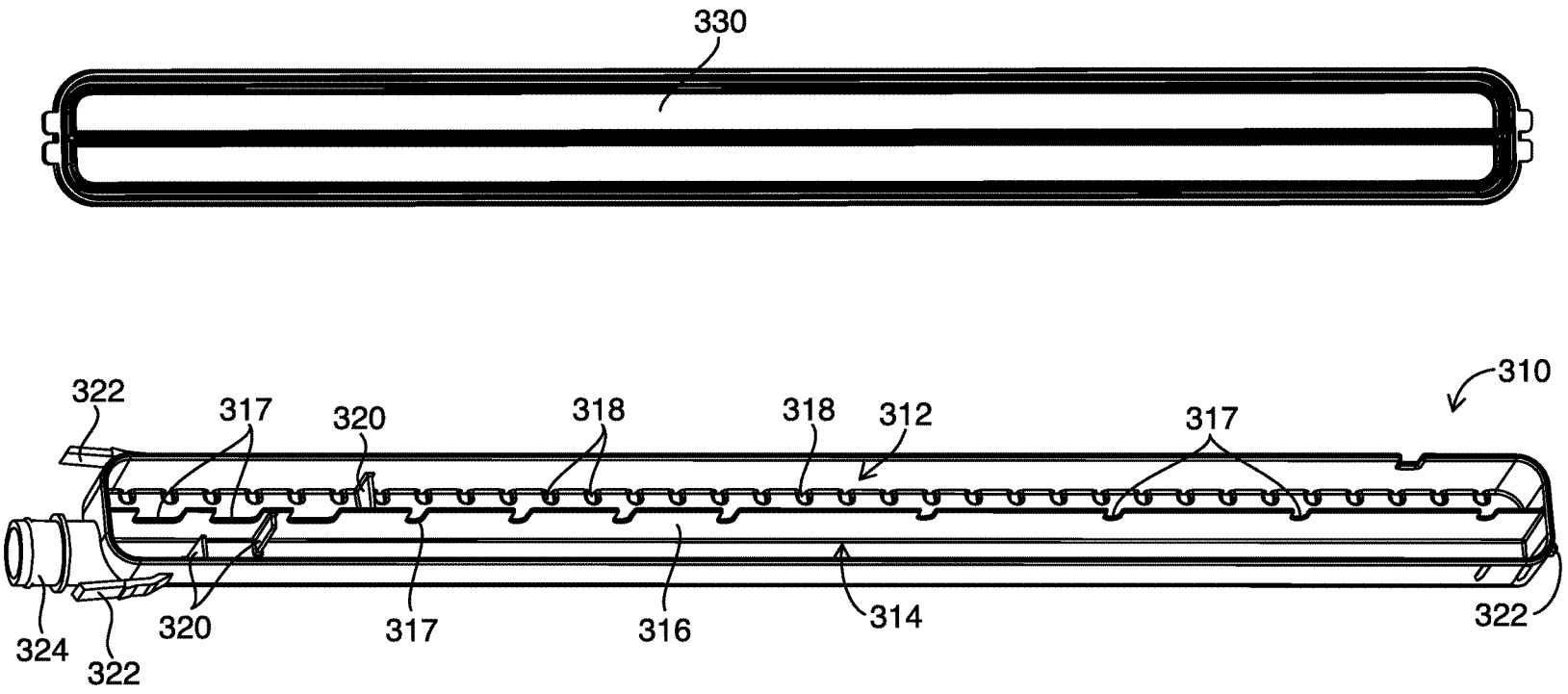
FIG. 1B (PRIOR ART)
FIG. 1B is a top perspective view of a water distributor according to the prior art.

As described in further elsewhere herein, although embodiments of the water distributor has outlet passageways in a substantially vertical wall of the water distributor, the water distributor may be a single part that can be molded inexpensively using a "straight pull" injection mold. Certain embodiments of the water distributor do not require multiple parts, and do not require "side pulls" built into the injection mold that are required by some prior art water distributor designs (e.g., the prior art designs shown in FIGS. 1A and 1B).

Figure 2:
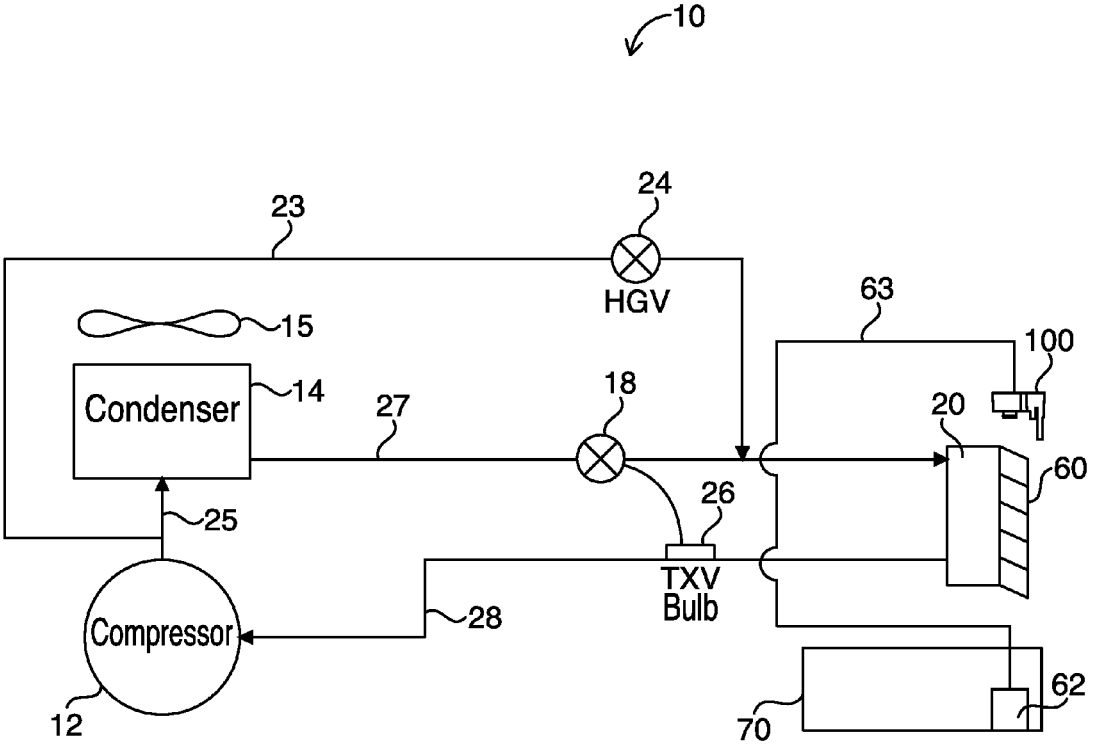
FIG. 2 is a schematic drawing of an ice maker having various components according to one embodiment of the invention.
Figure 4:
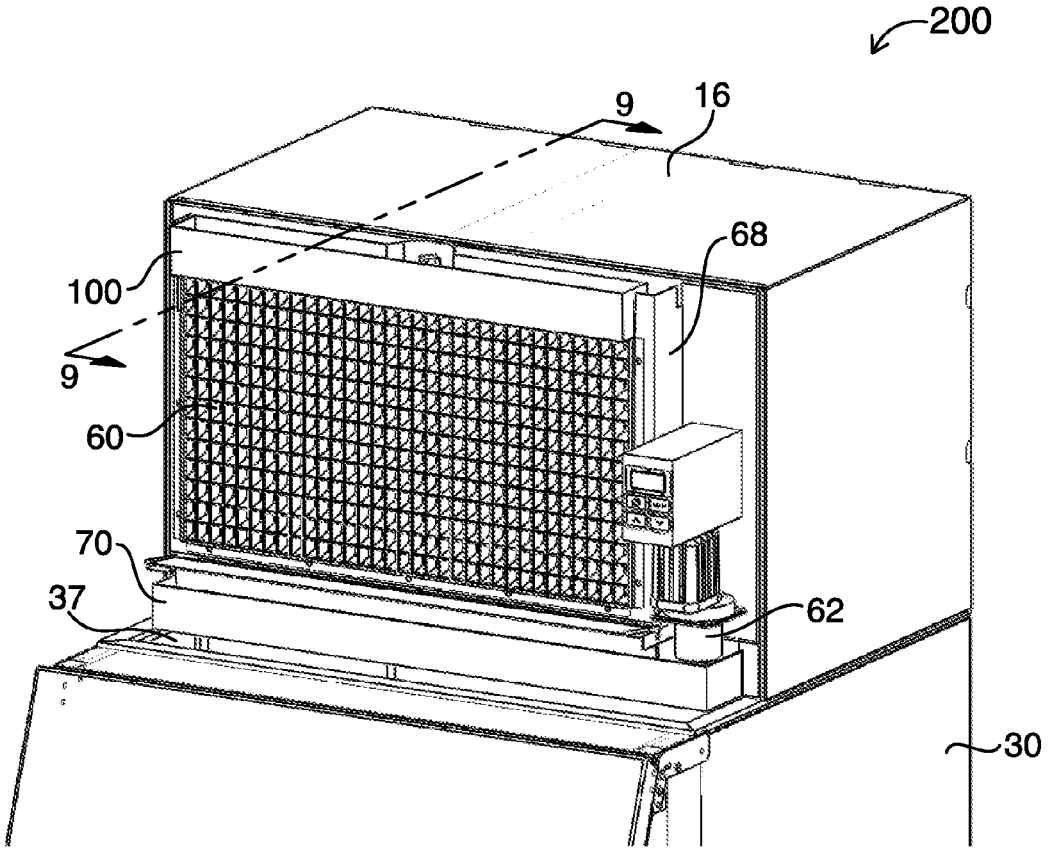
FIG. 4 is a right perspective view of an ice maker assembly with an ice maker disposed within a cabinet wherein the cabinet is disposed on an ice storage bin assembly according to one embodiment of the invention.
Figure 5:
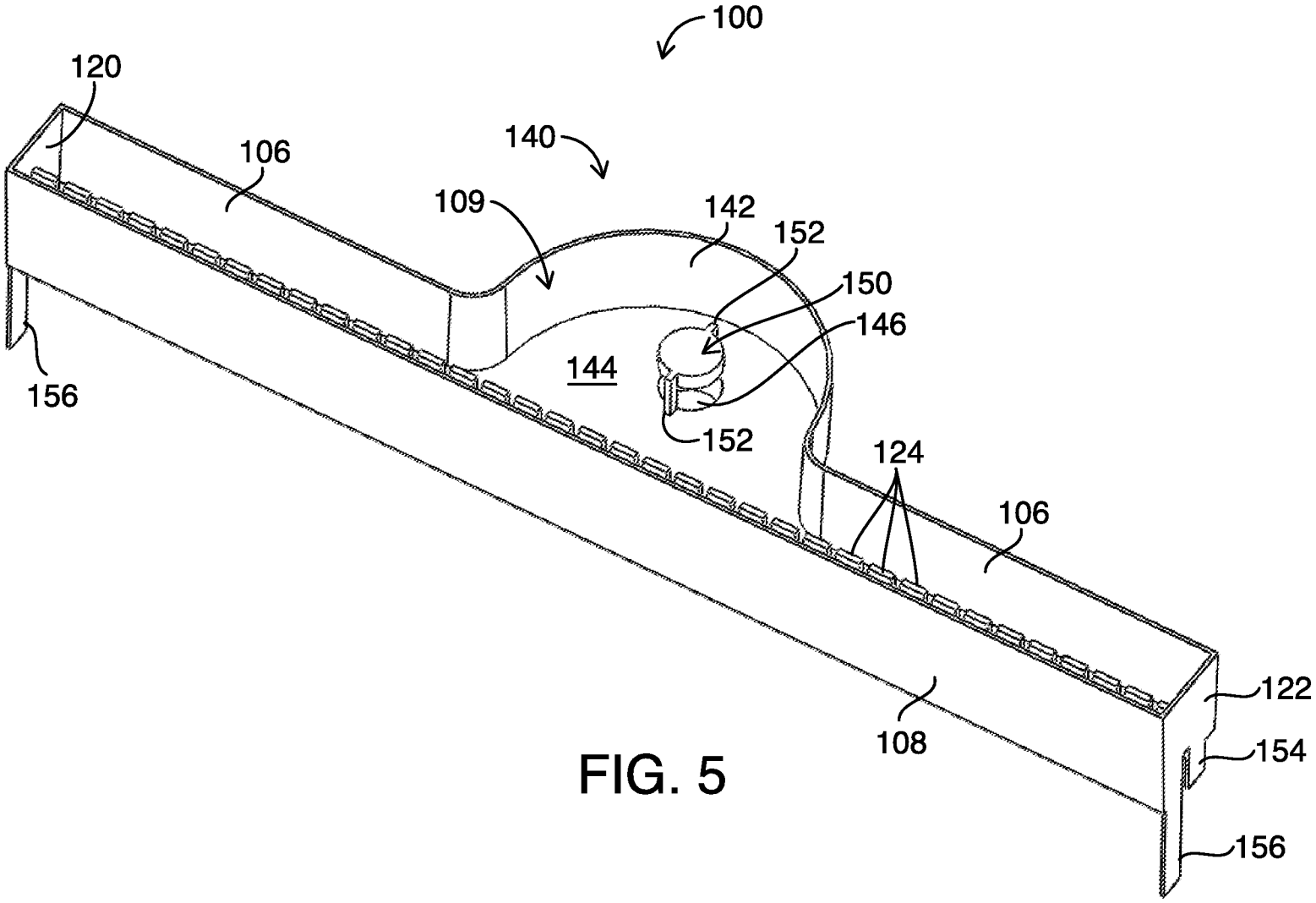
FIG. 5 is a right perspective view of a water distributor according to one embodiment of the invention.

FIG. 2 illustrates certain principal components of one embodiment of ice maker 10 having a refrigeration system and ice making or water system. The refrigeration system of ice maker 10 may include compressor 12, condenser 14 for condensing compressed refrigerant vapor discharged from the compressor 12, thermal expansion device 18 for lowering the temperature and pressure of the refrigerant, evaporator assembly 20, freeze plate 60 thermally coupled to evaporator assembly 20, and hot gas valve 24. In certain embodiments, freeze plate 60 may contain a large number of pockets (usually in the form of a grid of cells) on its surface where water flowing over the surface can collect (see FIG. 4).

Thermal expansion device 18 may include, but is not limited to, a capillary tube, a thermostatic expansion valve or an electronic expansion valve. In certain embodiments, where thermal expansion device 18 is a thermostatic expansion valve or an electronic expansion valve, ice maker 10 may also include a temperature sensing bulb 26 placed at the outlet of the evaporator assembly 20 to control thermal expansion device 18. In other embodiments, where thermal expansion device 18 is an electronic expansion valve, ice maker 10 may also include a pressure sensor (not shown) placed at the outlet of the evaporator assembly 20 to control thermal expansion device 18 as is known in the art. In certain embodiments that utilize a gaseous cooling medium (e.g., air) to provide condenser cooling, a condenser fan 15 may be positioned to blow the gaseous cooling medium across condenser 14. As described more fully elsewhere herein, a form of refrigerant cycles through these components via a lines 23, 25, 27, 28.

The water system of ice maker 10 may include water pump 62, water line 63, water distributor 100, and sump 70 located below freeze plate 60 adapted to hold water. During operation of ice maker 10, as water is pumped from sump 70 by water pump 62 through water line 63 into and then out water distributor 100, the water impinges on freeze plate 60, flows over the pockets of freeze plate 60 and freezes into ice. Sump 70 may be positioned below freeze plate 60 to catch the water coming off of freeze plate 60 such that the water may be recirculated by water pump 62 (see FIG. 4). In addition, hot gas valve 24 may be used to direct warm refrigerant from compressor 12 directly to evaporator assembly 20 to remove or harvest ice cubes from freeze plate 60 when the ice has reached the desired thickness. Ice maker 10 may have other conventional components not described herein, including, but not limited to, a water supply, a purge valve, a water drain, a controller, and a source of electrical energy.

Figure 3:
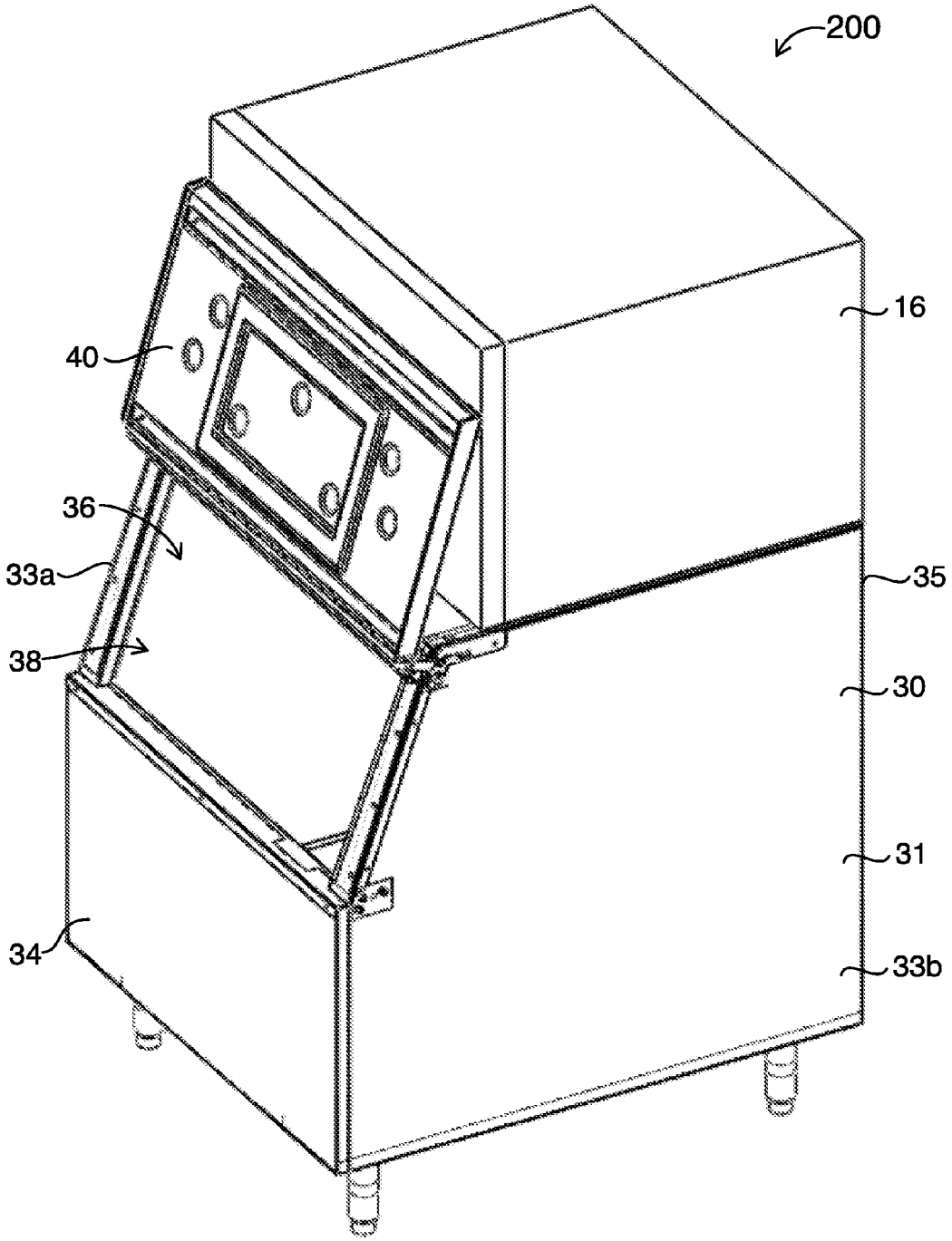
FIG. 3 is a right perspective view of an ice maker assembly with an ice maker disposed within a cabinet wherein the cabinet is disposed on an ice storage bin assembly according to one embodiment of the invention.

In many embodiments, as illustrated in FIG. 3, ice maker 10 may be disposed inside of a cabinet 16 which may be mounted on top of an ice storage bin assembly 30 forming an ice maker assembly 200. Cabinet 16 may be closed by suitable fixed and removable panels to provide temperature integrity and compartmental access, as will be understood by those in the art. Ice storage bin assembly 30 includes an ice storage bin 31 having a hole 37 (see FIG. 4) through which ice produced by ice maker 10 falls. The ice is then stored in cavity 36 until retrieved. Ice storage bin 31 further includes an opening 38 which provides access to the cavity 36 and the ice stored therein. Cavity 36, hole 37 and opening 38 may be formed by a left wall 33*a*, a right wall 33*b*, a front wall 34, a back wall 35 and a bottom wall (not shown). The walls of ice storage bin 31 may be thermally insulated with various insulating materials including, but not limited to, fiberglass insulation or open- or closed-cell foam comprised, for example, of polystyrene or polyurethane, etc. in order to retard the melting of the ice stored in ice storage bin 31. A door 40 can be opened to provide access to cavity 36.

Structure of Water Distributor

Figure 6:
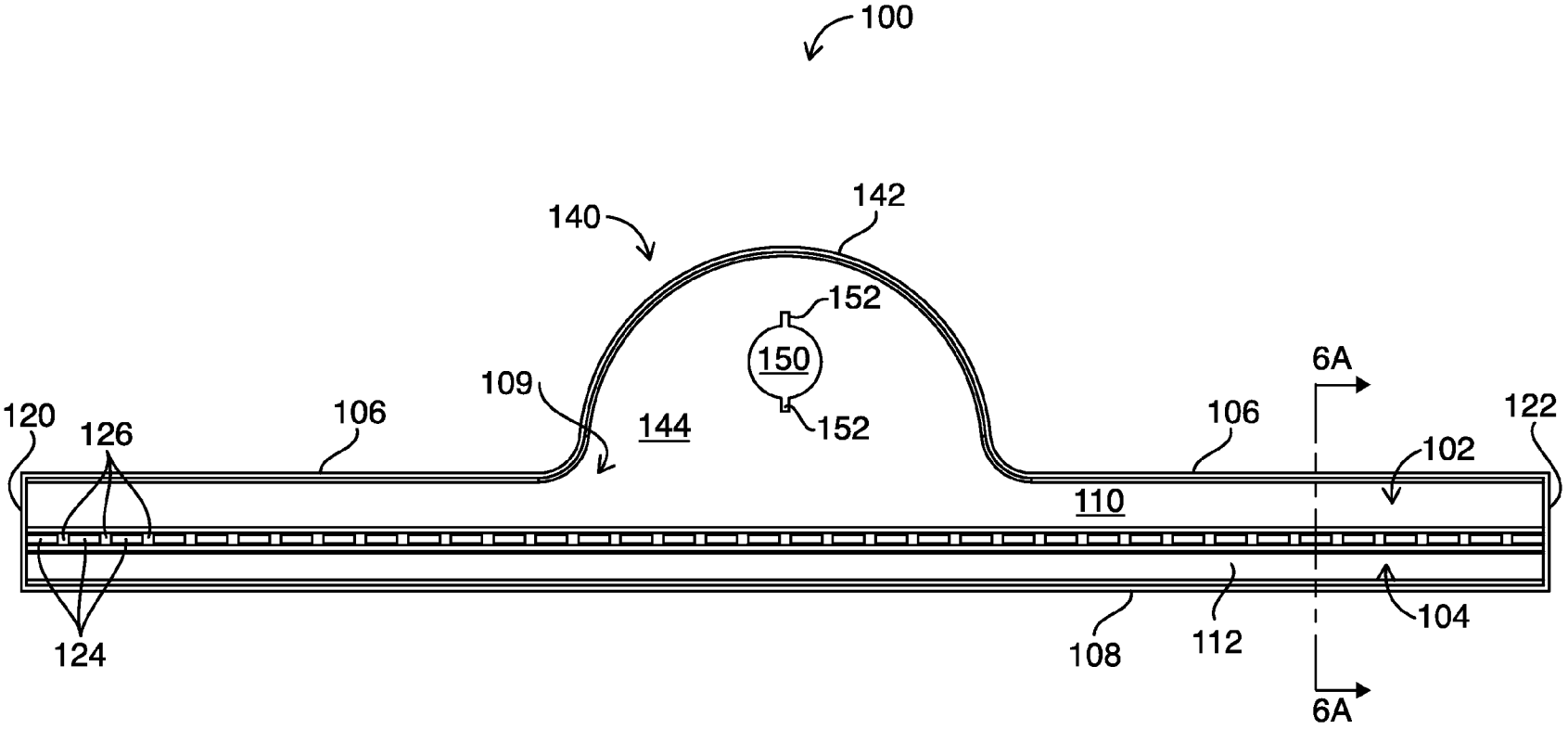
FIG. 6 is a top view of a water distributor according to one embodiment of the invention.
Figure 6A:
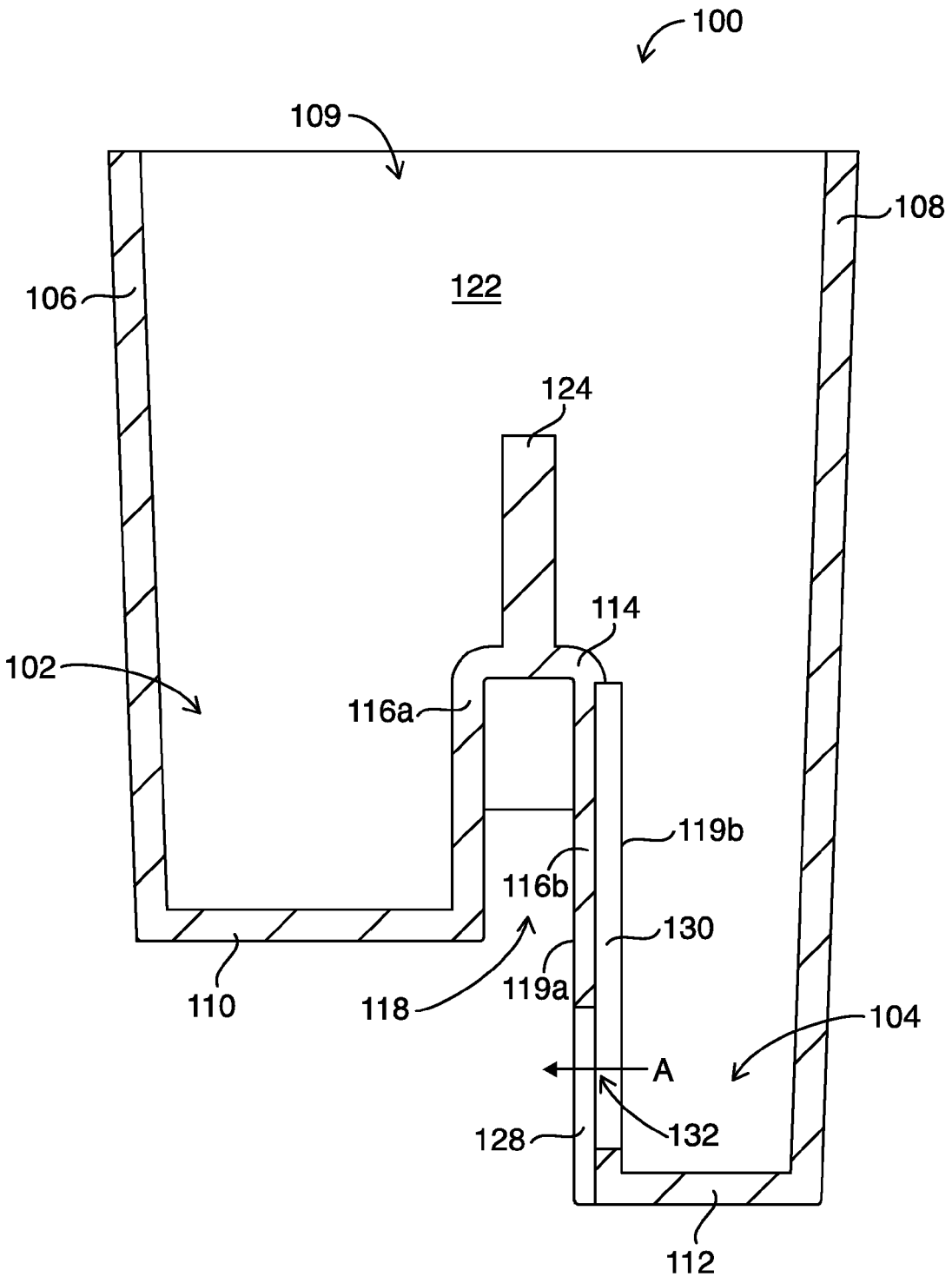
FIG. 6A is a left section view of a water distributor according to one embodiment of the invention.

Referring now to FIGS. 5-9, embodiments of water distributor 100 are described. Water distributor 100 includes first reservoir 102 having bottom 110 and second reservoir 104 having bottom 112. Additionally, water distributor 100 may have an open top 109. In various embodiments, second reservoir 104 may be lower in elevation than first reservoir 102 (see FIG. 6A). Accordingly, bottom 112 of second reservoir 104 may be disposed vertically below bottom 110 of first reservoir 102. Additionally, at least a portion of or, in certain embodiments, all of bottom 112 of second reservoir 104 may be horizontally offset from bottom 110 of first reservoir 102. As illustrated in FIG. 6A, bottom 112 of second reservoir 104 is completely horizontally offset from bottom 110 of first reservoir 102 such that there is no vertical overlap between bottom 110 of first reservoir 102 and bottom 112 of second reservoir 104 (i.e., no vertical line can be drawn to intersect bottom 110 of first reservoir 102 and bottom 112 of second reservoir 104). Additionally, central wall 114 may be disposed between first reservoir 102 and second reservoir 104. Central wall 114 may separate first reservoir 102 and second reservoir 104. Central wall 114 may be formed of first central wall portion 116*a* and second central wall portion 116*b*. In certain embodiments, channel 118 may be disposed between first central wall portion 116*a* and second central wall portion 116*b*. Channel 118 may be adapted to accept flange 61 of freeze plate 60 (see FIG. 9). In another embodiment, for example, no channel separates first central wall portion 116*a* and second central wall portion 116*b* of central wall 114 (see FIG. 6D). Water distributor 100 further includes back wall 106, front wall 108, left wall 120, and right wall 122 which connect to bottoms 110, 112 and central wall 114 so that first and second reservoirs 102, 104 can hold water.

Figure 6B:
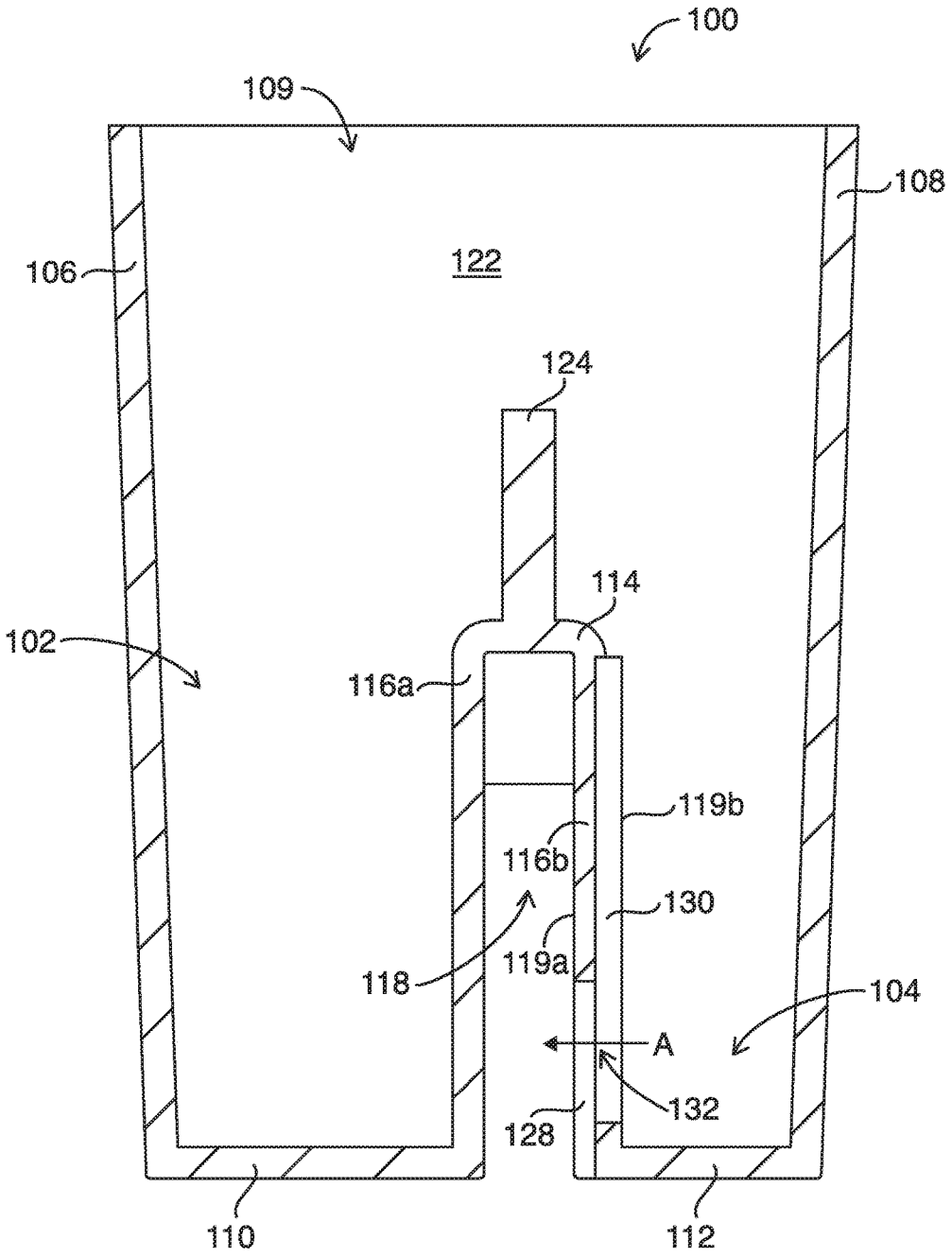
FIG. 6B is a left section view of a water distributor according to an alternative embodiment of the invention.
Figure 6C:
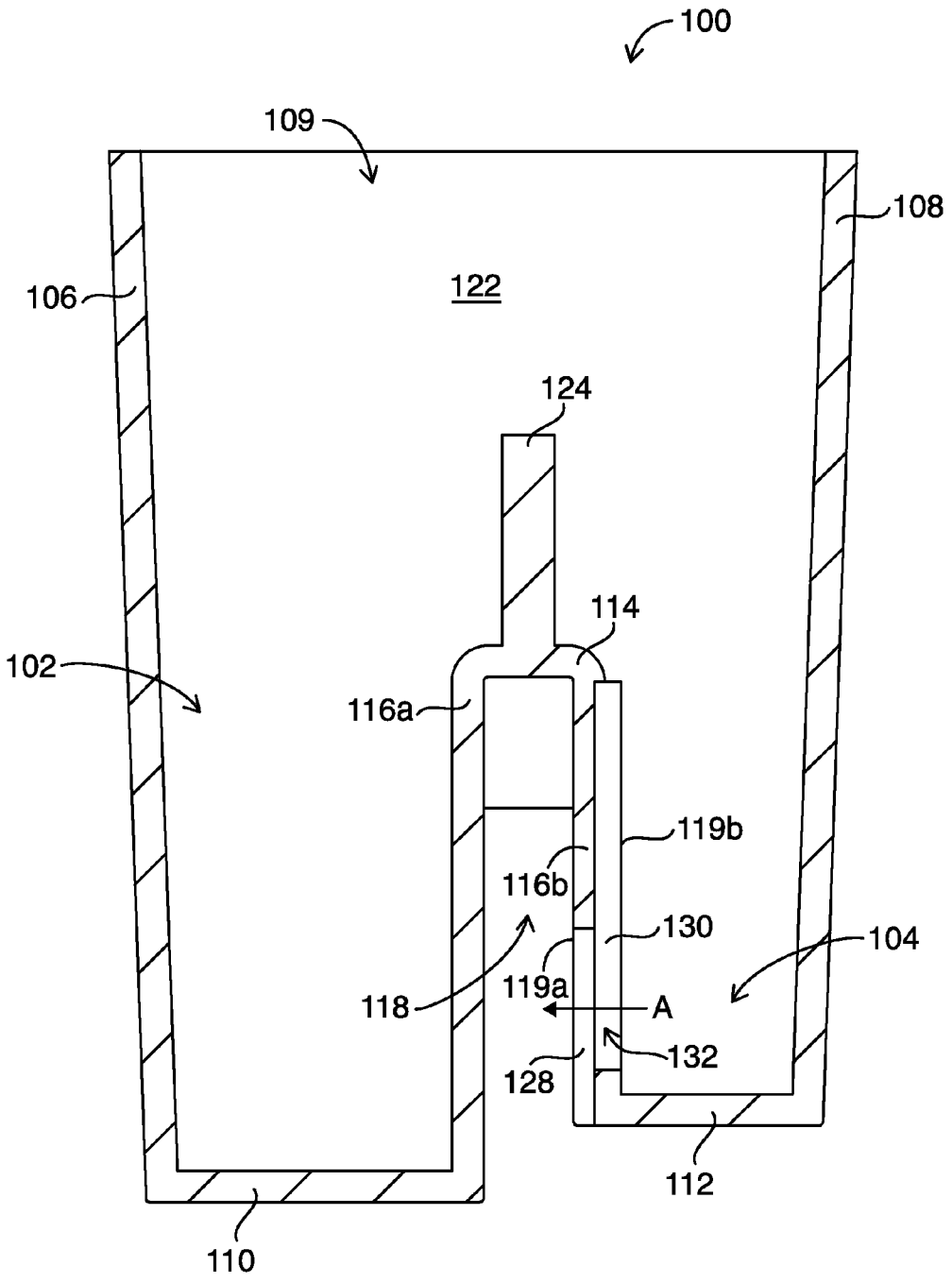
FIG. 6C is a left section view of a water distributor according to an alternative embodiment of the invention.
Figure 6D:
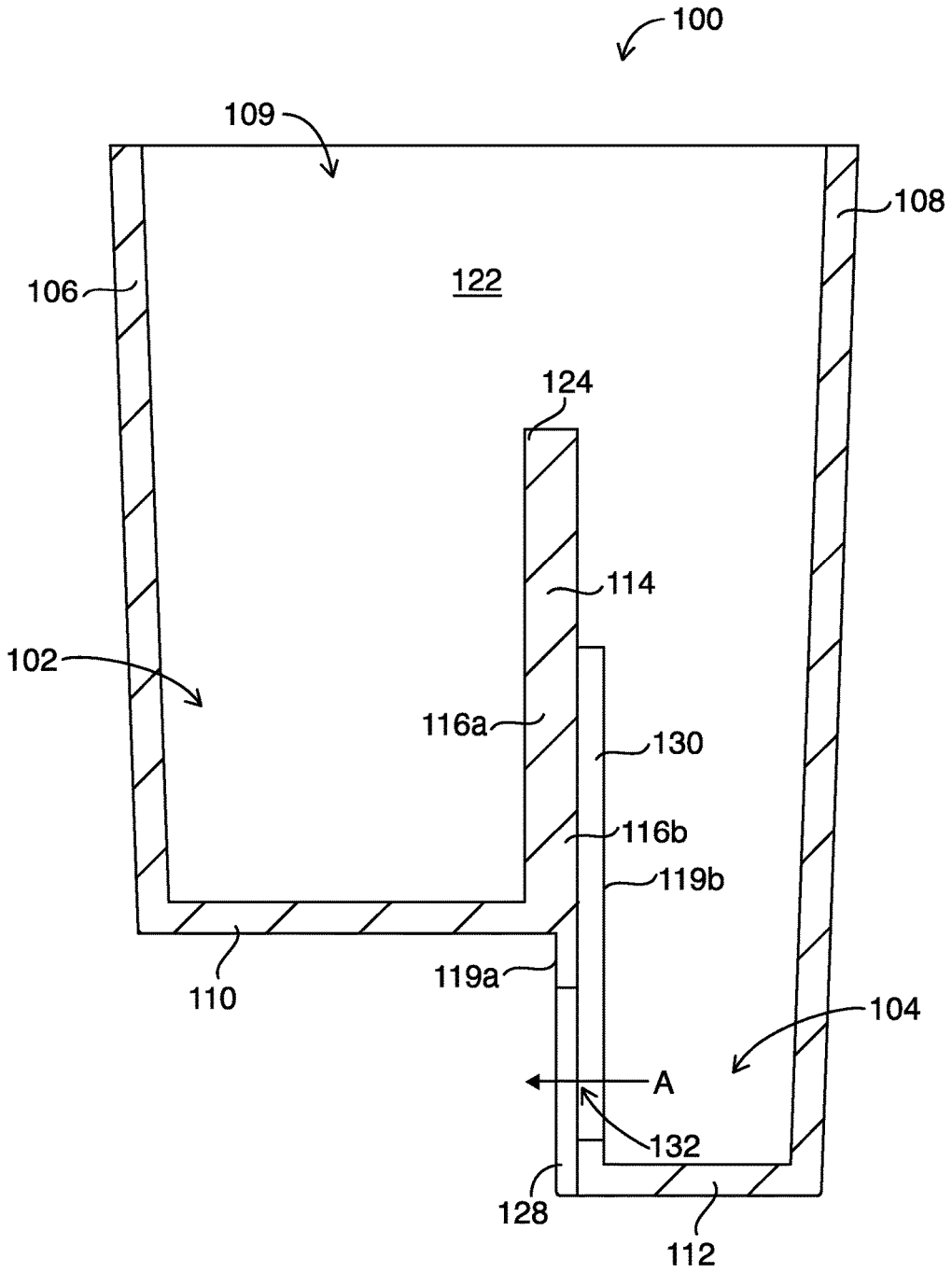
FIG. 6D is a left section view of a water distributor according to an alternative embodiment of the invention.

As described with respect to FIG. 6A, second reservoir 104 may be lower in elevation than first reservoir 102, however in other embodiments, second reservoir 104 may be at substantially the same elevation as first reservoir 102 or, in yet other embodiments, second reservoir 104 may be higher in elevation than first reservoir 102. Accordingly, in certain embodiments, as illustrated in FIG. 6B, bottom 112 of second reservoir 104 may be disposed at substantially the same elevation as bottom 110 of first reservoir 102. In other embodiments, as illustrated in FIG. 6C, bottom 112 of second reservoir 104 may be disposed vertically above bottom 110 of first reservoir 102.

As illustrated in FIGS. 5, 6, 7, and 7A, water distributor 100 further includes a population of teeth 124 disposed along central wall 114. The population of teeth 124 may be separated by a population of gaps 126 disposed between each one of the population of teeth 124. The population of gaps 126 provide fluid communication between first reservoir 102 and second reservoir 104. In various embodiments, the population of teeth 124 may extend substantially vertically away from bottoms 110, 112 of first and second reservoirs 102, 104, respectively. Each individual tooth 124 of the population of teeth 124 may be substantially equally spaced along central wall 114 (i.e., the distance between a first tooth 124 and a second tooth 124 may be equal to the distance between the second tooth 124 and a third tooth 124, etc.). Thus, the population of teeth 124 may be uniformly distributed along central wall 114. Accordingly, gaps 126 of the population of gaps 126 may be substantially equally spaced between individual teeth 124 along central wall 114 (i.e., the distance between a first gap 126 and a second gap 126 may be equal to the distance between the second gap 126 and a third gap 126, etc.). Thus, the population of gaps 126 may be uniformly distributed along central wall 114. In addition to being uniformly distributed along central wall 114, gaps 126 may also have a uniform width along the central wall 114 (i.e., the width of a first gap 126 may be equal to the width of a second gap 126, wherein the widths of both the first gap 126 and the second gap 126 are equal to the width of a third gap 126, etc.) The uniform distribution and width of the population of gaps 126 is a departure from certain water distributors in the prior art.

Referring now to FIGS. 5, 6, 7, 8, 8A, and 9, water distributor 100 may further include a water inlet area 140 which may be in fluid communication with first reservoir 102. Water inlet area 140 may be substantially semi-circular in shape; however it will be understood that water inlet area 140 may be any shape without departing from the scope of the invention. The diameter of the water inlet area 140 may be substantially in line with rear wall 106. Water inlet area 140 may be centrally located along the width of water distributor 100. However, in various embodiments, water inlet area 140 may be disposed proximate left wall 120 or proximate right wall 122. Water inlet area 140 may include a water inlet wall 142 which may be formed as a part of back wall 106. Additionally, water inlet area 140 may include a water inlet bottom 144. In various embodiments, water inlet bottom 144 may be coplanar with first bottom 110 of first reservoir 102. Disposed in water inlet bottom 144 may be an inlet passageway 146. Water may be supplied to water distributor through inlet passageway 146 by water pump 62 through water line 63 which may be in fluid communication with water pump 62 and water distributor 100.

Accordingly, water inlet area 140 may accommodate water supplied to water distributor 100 from sump 70 by water pump 62. Water inlet area 140 may further include nipple 148 to which a proximal end of water line 63 may be connected. A distal end of water line 63 may be connected to water pump 62. Nipple 148 may extend substantially vertically downward such that water may be pumped substantially vertically upward into water distributor 100. In certain embodiments, nipple 148 may include any type and/or construction of hose connecting element known in the art including, but not limited to, a population of barbs, a population of rings, threads, etc. In many typical water distributors, water is pumped substantially horizontally into the water distributor. A cap 150 may be disposed above inlet passageway 146 and may be affixed to water distributor 100 by a population of stanchions 152 (e.g., 1 or more stanchions, 2 or more stanchions, 3 or more stanchions, etc.). Cap 150 may assist in preventing the supplied water from squirting, spewing, or gushing upward from inlet passageway 146 and potentially out open top 109 of water distributor 100. Accordingly, cap 150 may assist in preventing water from leaking out open top 109 of water distributor 100.

Among the benefits of water distributor 100 is that the design and orientation of structures permit lower inlet water pressures when compared to prior art designs. This permits the use of smaller water pumps 62 and may result in reduced energy consumption when compared to prior art designs. One way that reduced inlet pressures may be achieved is through the elimination of a convoluted water flow path that needs high water pressure to overcome. In various embodiments of water distributor 100, water flows through the structure of water distributor 100 primarily by gravity, not by a higher water pressure from water pump 62.

To further assist in preventing water from squirting, spewing, or gushing from water distributor 100 as the water passes through inlet passageway 146, the diameter of inlet passageway 146 may be larger than in prior art water distributors. By increasing the cross sectional area of inlet passageway 146 by increasing its diameter, there is more area for the water to flow through. This allows the water to flow through inlet passageway 146 with a slower velocity which prevents squirting, spewing, or gushing of the water out inlet passageway 146. In certain embodiments, for example, the diameter of inlet passageway 146 may be about 1.27 centimeters (about 0.5 inches) to about 5.08 centimeters (about 2.0 inches) (e.g., about 1.27 centimeters (about 0.5 inches), about 1.905 centimeters (about 0.75 inches), about 2.54 centimeters (about 1.0 inch), about 3.175 centimeters (about 1.25 inches), about 3.81 centimeters (about 1.5 inches), about 4.445 centimeters (about 1.75 inches), about 5.08 centimeters (about 2.0 inches)). The lower water pressures permitted by water distributor 100 eliminates the need for a lid to cover the entirety of water distributor 100.

While inlet passageway 146, nipple 148, cap 150 and stanchions 152 have been described as being disposed in water inlet area 140, it will be understood that in certain embodiments of water distributor 100, inlet passageway 146, nipple 148, cap 150 and stanchions 152 may be disposed in first reservoir 102 without departing from the scope of the invention. Accordingly, in certain embodiments, water inlet area 140 may not be required.

Referring now to FIGS. 6A, 6B, 6C, 6D, 7A, 8, and 9, a population of outlet passageways 132 may be disposed along the length of second central wall portion 116*b* proximate bottom 112 of second reservoir 104. In various embodiments, outlet passageways 132 of the population of outlet passageways 132 may be substantially equally spaced along the length of second central wall portion 116*b* (i.e., the distance between a first outlet passageway 132 and a second outlet passageway 132 may be equal to the distance between the second outlet passageway 132 and a third outlet passageway 132, etc.). Each outlet passageway 132 may be formed by the overlap of an outer recess 128 disposed on outer surface 119*a* of second central wall portion 116*b* and an inner recess 130 disposed on inner surface 119*b* of second central wall portion 116*b* (see FIGS. 6A, 6B, 6C, 6D). Accordingly, a population of outer recesses 128 and inner recesses 130 may overlap to form the population of outlet passageways 132.

Figure 7:
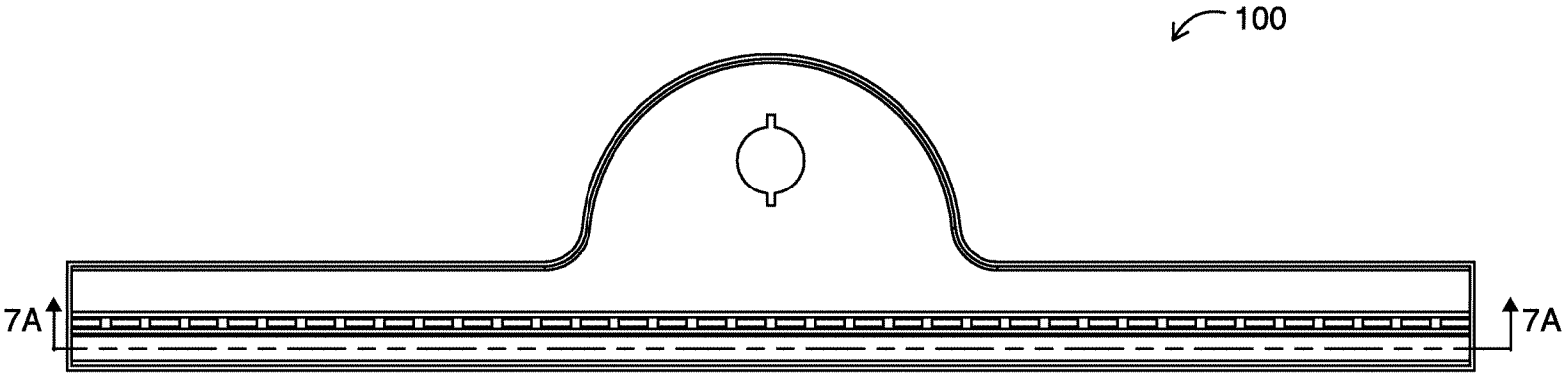
FIG. 7 is a top view of a water distributor according to one embodiment of the invention.
Figure 7A:
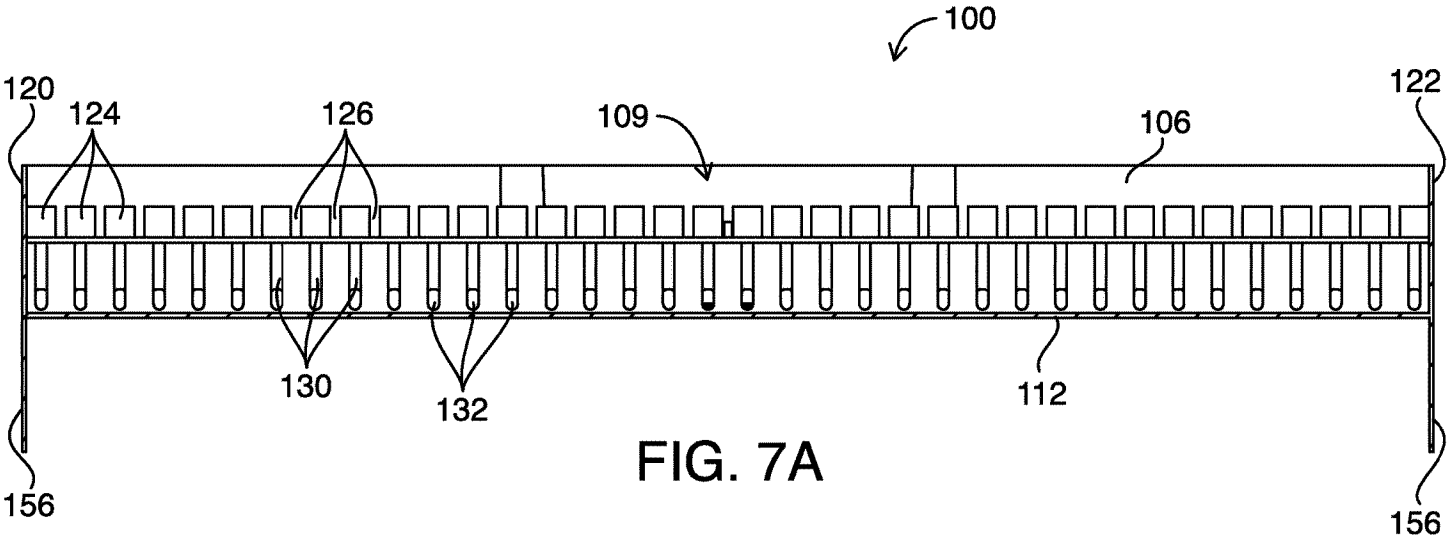
FIG. 7A is a front section view of a water distributor according to one embodiment of the invention.
Figure 8:
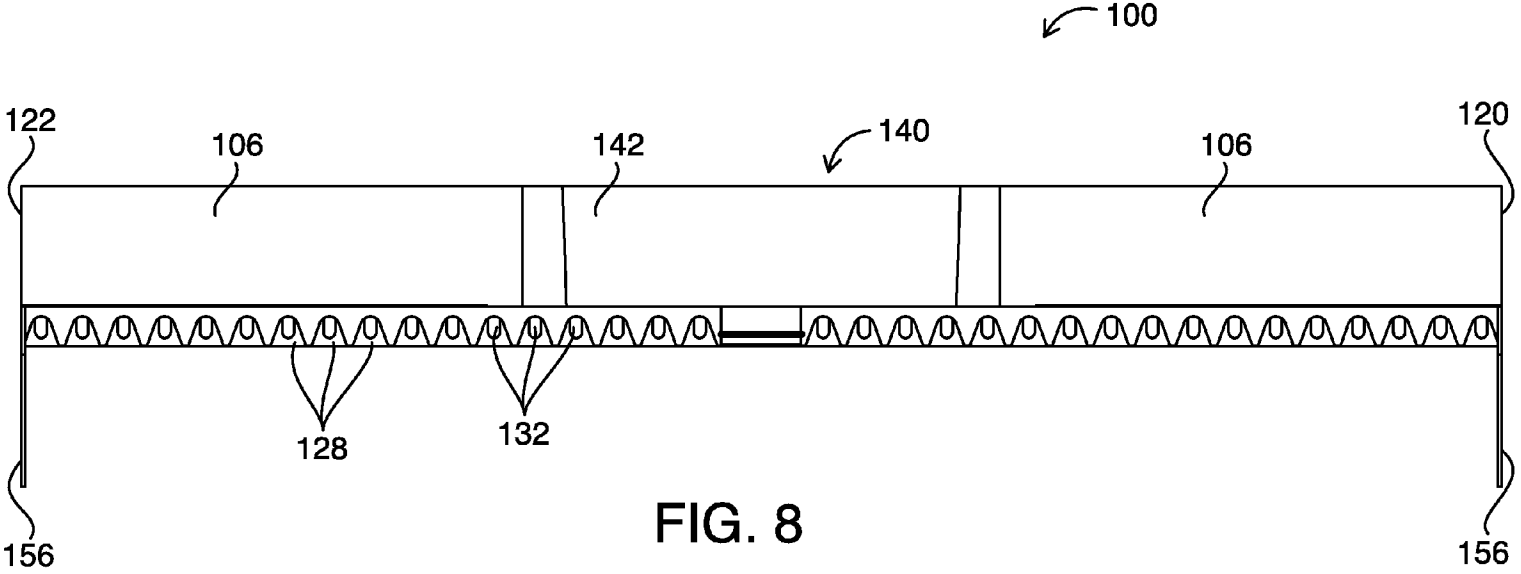
FIG. 8 is a rear view of a water distributor according to one embodiment of the invention.
Figure 8A:
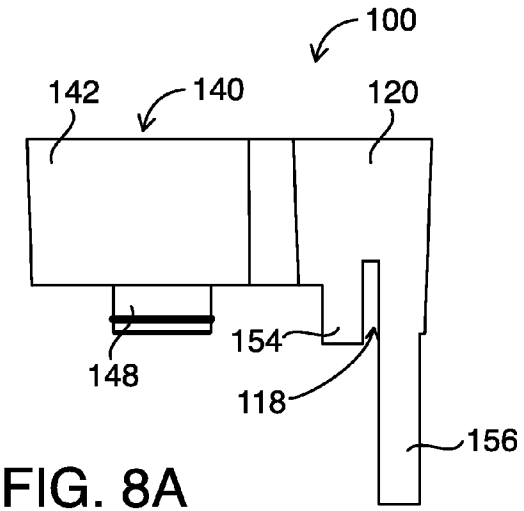
FIG. 8A is a left view of a water distributor according to one embodiment of the invention.

In various embodiments, as shown in FIG. 8, outer recesses 128 may have a shape substantially that of an arch wherein the base of the arch is disposed proximate bottom 112 of second reservoir 104. Outer recesses 128 may also extend a depth from outer surface 119*a* into second central wall portion 116*b* of about half of the thickness of second central wall portion 116*b*. In various embodiments, as shown in FIG. 7A, inner recesses 130 may have a shape substantially that of a partial obround. Inner recesses 130 may be partially obround in that inner recesses 130 only have one semi-circular portion instead of two semi-circular portions, wherein the single semi-circular portion is disposed proximate bottom 112 of second reservoir 104. Inner recesses 130 may also extend a depth from inner surface 119*b* into second central wall portion 116*b* about half the thickness of second central wall portion 116*b*. Each of the population of inner recesses 130 may be disposed directly opposite to a corresponding one of each of the outer recesses 128. Accordingly, the overlapping portions of inner recesses 130 and outer recesses 132 form outlet passageways 132 wherein outlet passageways 132 may have a shape substantially that of an obround.

In certain embodiments, as illustrated in FIGS. 5, 7A, 8 and 8A, first and second tabs 154, 156 may extend downward from left and right walls 120, 122. First and second tabs 154, 156 may be co-planar with left and right walls 120, 122. In certain embodiments, for example, second tabs 156 may be longer than first tabs 154. In other embodiments, for example, first tabs 154 may be longer than second tabs 156. In other embodiments, for example, first tabs 154 and second tabs 156 may be substantially equal in length. First and second tabs 154, 155 may assist in supporting water distributor 100 and may provide greater stability when water distributor 100 is mounted to flange 61 of freeze plate 60 (see FIG. 9). First and second tabs 154, 155 may additionally help direct the water across freeze plate 60 and help keep the water flow from wandering away from freeze plate 60. The population of gaps 126 and the population of outlet passageways 132 may be staggered as illustrated; however in other embodiments the population of gaps 126 and the population of outlet passageways 132 may be aligned without departing from the scope of the invention.

Production of Water Distributor

The design and orientation of structures of water distributor 100 as described herein permit a simplified production process of water distributor 100 as compared to prior art designs. Various embodiments of water distributor 100, as described herein, are designed as a "straight pull" part which allows water distributor 100 to be molded through high speed injection molding using a straight pull mold. A straight pull mold may only require the use of two mold halves which form a cavity into which resin may be injected to form the part. Straight pull molds generally do not include "side actions" or "side pulls". Normally, side pulls or side actions must be added to the mold to form undercuts or holes in injection molded parts. Side pulls introduce an additional step in the injection molding process and thus increase the cycle time per part. This can prevent the use of high speed injection molding and, as a result, may greatly increase the cost of the mold and the cost to produce a part. Accordingly, by designing water distributor 100 to be produced in a straight pull mold, cost and complexity can be reduced and production rates can be increased.

Various features and structures of water distributor 100 may be designed to permit the use of straight pull injection molding. For example, inlet passageway 146 and cap 150 may be the same diameter and therefore may be formed by portions of the two cooperating mold halves used to form water distributor 100. One mold half may have a cylindrical-shaped core or male portion which is adapted to fit inside a cylindrical-shaped cavity or female portion of the second mold half. The outer diameter of the core may be substantially equal to the inner diameter of the cavity such that the sides of the core and cavity slide past each other and create a seal or "shut-off" when the two cooperating mold halves close. Shut-offs permit the molding of holes without the use of side pulls. The shut-off between the core and the cavity create inlet passageway 146. Furthermore, the core may not insert completely into the cavity, thereby leaving a gap between the end of the core and the end of the cavity. Accordingly, when resin is injected into the two cooperating mold halves, cap 150 may be molded in the gap between the core and the cavity. The cavity may further include a groove, or channel in which the population of stanchions 152 may be formed. Accordingly, the core, cavity, gap and shut-off created there between permit the formation of inlet passageway 146 and cap 150 without the use of a side pull.

The population of outlet passageways 132 can be formed in a similar manner using another shut-off. One mold half may have a population of first faces for forming the population of outer recesses 128 and a second mold half may have a population of second faces for forming the population of inner recesses 130. When the two cooperating mold halves close, the population of first faces and the population of second faces slide past each other to create a population of shut-offs. This population of shut-offs between the populations of first and second faces create the population of outlet passageways 132. Accordingly, this shut-off permits the molding of outlet passageways 132 without the use of side pulls. The population of teeth 124 and the population of gaps 126 may also be formed using other shut-offs in the two cooperating mold halves. By forming inlet passageway 146, the population of outlet passageways 132 and/or the population of teeth 124 and gaps 126, water distributor 100 can be molded as a "straight pull" part while still forming inlet passageway 146, the population of outlet passageways 132 and/or the population of teeth 124 and gaps 126 that mimic undercuts.

Operation of Ice Maker and Water Distributor

Having described each of the individual components of one embodiment of ice maker 10, the manner in which the components interact and operate various embodiments may now be described. During operation of ice maker 10 in a cooling cycle, compressor 12 receives low-pressure, substantially gaseous refrigerant from evaporator assembly 20 through suction line 28, pressurizes the refrigerant, and discharges high-pressure, substantially gaseous refrigerant through discharge line 25 to condenser 14. In condenser 14, heat is removed from the refrigerant, causing the substantially gaseous refrigerant to condense into a substantially liquid refrigerant.

After exiting condenser 14, the high-pressure, substantially liquid refrigerant is routed through liquid line 27 to thermal expansion device 18, which reduces the pressure of the substantially liquid refrigerant for introduction into evaporator assembly 20. As the low-pressure expanded refrigerant is passed through tubing of evaporator assembly 20, the refrigerant absorbs heat from the tubes contained within evaporator assembly 20 and vaporizes as the refrigerant passes through the tubes. Low-pressure, substantially gaseous refrigerant is discharged from the outlet of evaporator assembly 20 through suction line 28, and is reintroduced into the inlet of compressor 12.

In certain embodiments of the invention, at the start of the cooling cycle, a water fill valve (not shown) is turned on to supply a mass of water to sump 70, wherein ice maker 10 will freeze some or all of the mass of water into ice. After the desired mass of water is supplied to sump 70, the water fill valve may be closed. Water pump 62 circulates the water from sump 70 to freeze plate 60 via water line 63 and water distributor 100. Compressor 12 causes refrigerant to flow through the refrigeration system. The water that is supplied by water pump 62 then begins to cool as it contacts freeze plate 60, returns to water sump 70 below freeze plate 60 and is recirculated by water pump 62 to freeze plate 60. Once the water is sufficiently cold, water flowing across freeze plate 60 starts forming ice cubes. After the ice cubes are formed, water pump 62 is turned off and hot gas valve 24 is opened allowing warm, high-pressure gas from compressor 12 to flow through hot gas bypass line 23 to enter evaporator assembly 20, thereby harvesting the ice by warming freeze plate 60 to melt the formed ice to a degree such that the ice may be released from freeze plate 60 and falls through hole 37 (see FIG. 4) into ice storage bin 31 where the ice can be temporarily stored and later retrieved. Hot gas valve 24 is then closed and the cooling cycle can repeat.

Figure 9:
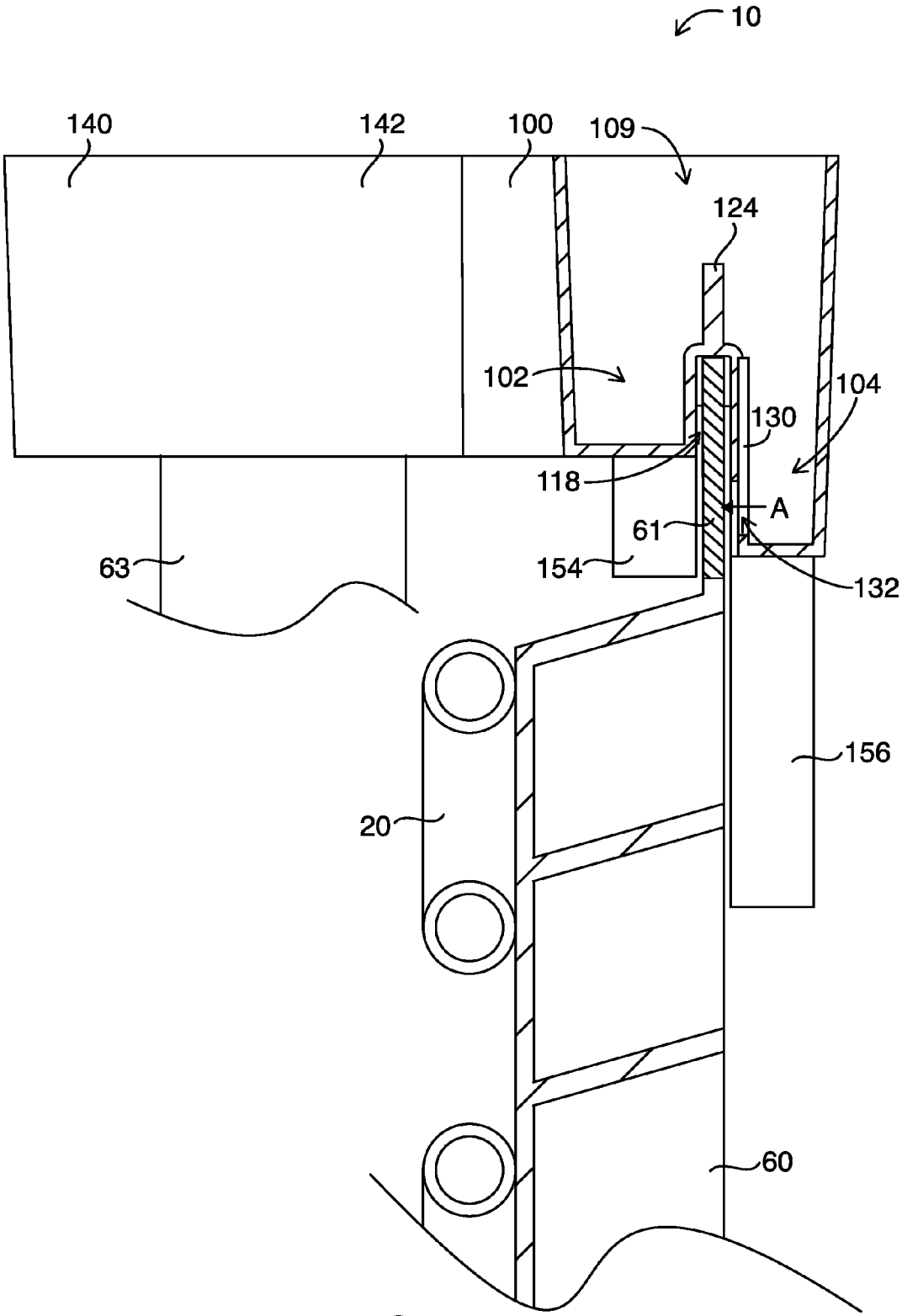
FIG. 9 is a left section view of a water distributor according to one embodiment of the invention.

Referring now to FIG. 9, water distributor 100 is affixed to ice maker 10. Water distributor 100 may be mounted on flange 61 that projects upwardly from freeze plate 60. In certain embodiments, for example, flange 61 is formed as a part of or attached to freeze plate 60. In various embodiments, water distributor 100 may be affixed in an operating position in ice maker 10 by placing channel 118 over flange 61 so that flange 61 inserts into channel 118. Flange 100 may assist in supporting water distributor 100 in ice maker 10. In certain embodiments, a portion of evaporator frame 68 (see FIG. 4) may additionally or alternatively insert into channel 118.

Specifically water distributor 100 distributes water over freeze plate 60 as follows. Water pump 62 supplies water to water distributor 100 via water line 63 attached to nipple 148. The supplied water enters water distributor 10 through inlet passageway 146. Because nipple 148 and inlet passageway 146 are disposed in bottom 144 of water inlet area 140, the momentum of the entering water is substantially upward instead of horizontal. The benefit of this substantially upward, rather than horizontal, momentum is that the supplied water is not directed toward the population of teeth 124 or toward or over central wall 114 where it could send excess water into second reservoir 104 and create uneven water flow from water distributor 10. Moreover, cap 150 may assist in preventing the supplied water from squirting, spewing, or gushing upward from inlet passageway 146 and potentially out open top 109 of water distributor 100. Accordingly, cap 150 may assist in preventing water from leaking out open top 109 of water distributor 100.

The supplied water then flows from water inlet area 140 into first reservoir 102, thereby filling first reservoir 102 until the water level rises to the level of the population of gaps 126 between the population of teeth 124 along central wall 114. The water then flows through the population of gaps 126 and into second reservoir 104. Second reservoir 104 then starts to fill with the supplied water. As second reservoir 104 fills, the supplied water reaches the population of outlet passageways 132 and flows through the population of outlet passageways 132. Because the population of outlet passageways 132 are formed in second central wall portion 116*b*, the supplied water exits the population of outlet passageways 132 with horizontal velocity component (see Arrow A of FIGS. 6A, 6B, 6C, 6D, 9). Due to the horizontal velocity component of the supplied water, the supplied water exiting the population of outlet passageways 132 will impinge on flange 61 of freeze plate 60. When the supplied water impinges flange 61 of freeze plate 60, the supplied water may form into a sheet of water and may evenly flow into freeze plate 60. The arch shape of the population of outer recesses 128 may promote the formation of a sheet of water as the supplied water exits the populations of outlet passageways 132. Further due to the horizontal velocity component of the supplied water, no further redirection by another part of the ice maker 10 is required to direct the flow of the water toward freeze plate 60. As stated previously, first and second tabs 154, 156 may help direct the supplied water across freeze plate 60 and help keep the supplied water from flowing away from freeze plate 60.

Typical freeze plates 60 are formed of materials (e.g., copper, aluminum) which have high thermal conductivities, however in order to reduce the possibility of the supplied water freezing to flange 61 prior to the supplied water entering the grids of freeze plate 60 flange 61 may be formed of a material with a thermal conductivity less than the materials comprising freeze plate 60. Thus, in certain embodiments, flange 61 may be formed of stainless steel, plastic, or any material having a thermal conductivity less than that of copper or aluminum.

When water distributor 100 must be removed for cleaning, water distributor 100 can be removed from ice maker 10 by lifting water distributor 100 from flange 61. Water line 63 may remain attached to nipple 148 or water line 63 may be removed from nipple 148. No tools or loosening or removal of fasteners are required to remove water distributor 100 from atop freeze plate 60. As a result, the effort and time required to clean water distributor 100 is greatly reduced when compared to prior art water distributors. To return water distributor 100 to operation, channel 118 is placed over flange 61 and, if previously detached, water line 63 may be reattached.

Thus, there has been shown and described novel methods and apparatuses of an ice maker having an improved water distributor, which overcome many of the problems of the prior art set forth above. It will be apparent, however, to those familiar in the art, that many changes, variations, modifications, and other uses and applications for the subject devices and methods are possible. All such changes, variations, modifications, and other uses and applications that do not depart from the spirit and scope of the invention are deemed to be covered by the invention which is limited only by the claims which follow.

The invention claimed is:

1. A water distributor for use in an ice maker comprising:

(i) a first reservoir comprising a bottom and an inlet passageway, the inlet passageway located in the bottom of the first reservoir adapted to permit water to enter the first reservoir through the bottom;

(ii) a central wall comprising a first central wall portion and a second central wall portion;

(iii) a channel disposed between the first wall portion and the second wall portion of the central wall, wherein the channel is adapted to accept a flange of a freeze plate of an ice maker;

(iv) a second reservoir separated from the first reservoir by the central wall, the second reservoir comprising a bottom, (v) a population of teeth disposed along the central wall, wherein the population of teeth are separated by a population of gaps, and wherein water may flow from the first reservoir to the second reservoir through one or more of the population of gaps; and (vi) a population of outlet passageways disposed in the second central wall portion proximate the bottom of the second reservoir, wherein water may exit the second reservoir through one or more of the population of outlet passageways with a horizontal velocity component.

2. The water distributor of claim 1 further comprising a water inlet area in fluid communication with the first reservoir and wherein the inlet passageway is disposed in the water inlet area.

3. The water distributor of claim 1 further comprising a cap disposed above the inlet passageway wherein the cap is adapted to prevent water from squirting upward from inlet passageway.

4. The water distributor of claim 3 wherein the water inlet has a first diameter, the cap has a second diameter, and wherein the first diameter is substantially equal to the second diameter.

5. The water distributor of claim 3 wherein the cap is affixed to the water distributor by a population of stanchions.

6. The water distributor of claim 1 wherein the population of teeth are uniformly distributed along the central wall.

7. The water distributor of claim 1 wherein the population of gaps have a uniform width and wherein the population of gaps are uniformly distributed along the central wall.

8. The water distributor of claim 1 further comprising a nipple extending downward from the inlet passageway.

9. The water distributor of claim 1 further comprising a left wall and a right wall and wherein a population of tabs extend downward from one or more of the left wall and the right wall.

10. An ice maker for forming ice, the ice maker comprising:

(i) a refrigeration system comprising a compressor, a condenser, a thermal expansion device, an evaporator assembly, a freeze plate thermally coupled to the evaporator assembly, and a hot gas valve;

(ii) a water system comprising a water pump, a water distributor, a water line in fluid communication with the water pump and the water distributor, and a sump located below the freeze plate adapted to hold water, wherein the water distributor comprises:

(a) a first reservoir comprising a bottom and an inlet passageway, the inlet passageway located in the bottom of the first reservoir adapted to permit water to enter the first reservoir through the bottom;

(b) a central wall comprising a first central wall portion and a second central wall portion;

(c) a second reservoir separated from the first reservoir by the central wall, the second reservoir comprising a bottom;

(d) a population of teeth disposed along the central wall, wherein the population of teeth are separated by a population of gaps, and wherein water may flow from the first reservoir to the second reservoir through one or more of the population of gaps;

(e) a population of outlet passageways disposed in the second central wall portion proximate the bottom of the second reservoir, wherein water may exit the second reservoir through one or more of the population of outlet passageways with a horizontal velocity component; and wherein the freeze plate comprises a flange extending upwardly and wherein the water distributor further comprises a channel disposed between the first wall portion and the second wall portion of the central wall, wherein the channel is adapted to accept the flange of the freeze plate.

11. The ice maker of claim 10 wherein the water distributor further comprises a water inlet area in fluid communication with the first reservoir and wherein the inlet passageway is disposed in the water inlet area.

12. The ice maker of claim 10 wherein the water distributor further comprises a cap disposed above the inlet passageway wherein the cap is adapted to prevent water from squirting upward from inlet passageway.

13. The ice maker of claim 12 wherein the water inlet has a first diameter, the cap has a second diameter, and wherein the first diameter is substantially equal to the second diameter.

14. The ice maker of claim 12 wherein the cap is affixed to the water distributor by a population of stanchions.

15. The ice maker of claim 10 wherein the population of teeth are uniformly distributed along the central wall.

16. The ice maker of claim 10 wherein the population of gaps have a uniform width and wherein the population of gaps are uniformly distributed along the central wall.

17. The ice maker of claim 10 wherein the water distributor further comprises a nipple extending downward from the inlet passageway.

18. The ice maker of claim 10 wherein the water distributor further comprises a left wall and a right wall and wherein a population of tabs extend downward from one or more of the left wall and the right wall.

19. The ice maker of claim 10 further comprising:

a plurality of inner recesses disposed on an inner surface of the second central wall portion;

a plurality of outer recesses disposed on an outer surface of the second central wall portion; and wherein the outlet passageways are formed by an overlap of the outer recess and the inner recess.

20. A water distributor for use in an ice maker comprising:

(i) a first reservoir comprising a bottom and an inlet passageway, the inlet passageway located in the bottom of the first reservoir adapted to permit water to enter the first reservoir through the bottom;

(ii) a central wall comprising a first central wall portion and a second central wall portion;

(iii) a plurality of inner recesses disposed on an inner surface of the second central wall portion;

(iv) a plurality of outer recesses disposed on an outer surface of the second central wall portion;

(v) a channel disposed between the first wall portion and the second wall portion of the central wall, wherein the channel is adapted to accept a flange of a freeze plate of an ice maker;

(vi) a second reservoir separated from the first reservoir by the central wall, the second reservoir comprising a bottom, (vii) a population of teeth disposed along the central wall, wherein the population of teeth are separated by a population of gaps, and wherein water may flow from the first reservoir to the second reservoir through one or more of the population of gaps; and (viii) a population of outlet passageways disposed in the second central wall portion proximate the bottom of the second reservoir, wherein water may exit the second reservoir through one or more of the population of outlet passageways with a horizontal velocity component, wherein the outlet passageways are formed by an overlap of the outer recess and the inner recess.

21. The water distributor of claim 20 wherein the outer recesses extend a depth from the outer surface of the second central wall portion into the second central wall portion of about a half of a thickness of the second central wall portion.

22. The water distributor of claim 21 wherein the inner recesses extend a depth from the outer surface of the second central wall portion into the second central wall portion of about a half of a thickness of the second central wall portion.

23. The water distributor of claim 22 wherein each of the plurality of inner recesses is disposed directly opposite a corresponding one of the plurality of outer recesses.

24. The ice maker of claim 22 wherein the inner recesses have a shape substantially that of a partial obround.

25. The water distributor of claim 20 wherein the outlet passageways have a shape substantially that of an obround.

26. The water distributor of claim 20 wherein the outer recesses have a shape substantially that of an arch having a base disposed proximate the bottom of the second reservoir.

27. The water distributor of claim 26 wherein the inner recesses have a shape substantially that of a partial obround.

28. The ice maker of claim 19 wherein the outer recesses extend a depth from the outer surface of the second central wall portion into the second central wall portion of about a half of a thickness of the second central wall portion.

29. The ice maker of claim 28 wherein the inner recesses extend a depth from the outer surface of the second central wall portion into the second central wall portion of about a half of a thickness of the second central wall portion.

30. The ice maker of claim 29 wherein each of the plurality of inner recesses is disposed directly opposite a corresponding one of the plurality of outer recesses.

31. The ice maker of claim 19 wherein the outlet passageways have a shape substantially that of an obround.

32. The ice maker of claim 19 wherein the outer recesses have a shape substantially that of an arch having a base disposed proximate the bottom of the second reservoir.

* * * * *